US006164629A

United States Patent [19]

Michael et al.

[11] Patent Number: 6,164,629

[45] Date of Patent: Dec. 26, 2000

[54] OUTDOOR RAILING SYSTEM AND RAILS

[75] Inventors: Stephen W. Michael; John M. Pastore, both of Greer; James R. Hall, Jr., Lyman, all of S.C.

[73] Assignee: Spartanburg Forest Products, Inc., Spartanburg, S.C.

[21] Appl. No.: 09/252,597

[22] Filed: Feb. 12, 1999

[51] Int. Cl.[7] ..... E04H 17/14

[52] U.S. Cl. ..... 256/65; 256/59; 256/67

[58] Field of Search ..... 256/21, 22, 59, 256/65, 67, 19

[56] References Cited

U.S. PATENT DOCUMENTS 5,572,845 11/1996 DeSouza ..... 256/25

FOREIGN PATENT DOCUMENTS 92088 10/1961 Denmark .

393697 6/1933 United Kingdom ..... 256/65

OTHER PUBLICATIONS

Drawing of Admitted Prior Art Rail Cap Device, Undated.

*Primary Examiner*—Lynne H. Browne
*Assistant Examiner*—Tomlyne A Malcolm
*Attorney, Agent, or Firm*—Dority & Manning, P.A.

[57] ABSTRACT

An outdoor railing system has a plurality of spindles attached between upper and lower rails. Each rail includes a plurality of equally spaced recess configurations defined along the length thereof in the inwardly disposed surface for receipt of the spindle ends. Each of the recess configurations includes a first multi-sided recess having a first size and a second multi-sided recess defined within the first multi-sided recess. The second multi-sided recess is of a smaller size than the first recess for anchoring spindles having a correspondingly smaller end size.

17 Claims, 4 Drawing Sheets

OUTDOOR RAILING SYSTEM AND RAILS

BACKGROUND OF THE INVENTION

The present invention relates generally to railing systems especially suited for outdoor use, and more particularly to a top and bottom rail configuration for such systems.

Railing systems for any number of outdoor applications are well known. For example, residential decks, pool decks, playgrounds, etc., all utilize any number of conventional railing systems. Such decking and railing systems are typically made of pressure treated lumber particularly suited for outdoor use. With conventional railing systems, spindles are vertically disposed between a top and bottom rail. Typically, the spindles are nailed or screwed onto the flat inwardly facing or side surfaces of the top and bottom rails. In order to provide the railing system with a "finished" appearance, face boards are typically attached to the side edges thereby defining a generally U-shaped channel with the rails into which the ends of the spindles extend. However, this conventional configuration has significant drawbacks. For example, the U-shaped channel is a favorite nesting place for any manner of insects, including wasps, bees, and the like. Also, this system requires additional materials, for example the side face boards, and is fairly labor intensive in that the spindles must first be screwed or nailed to the top and bottom rails and then the face boards must be attached to the rails. This process and expense is undesirable, particularly for the residential decking industry wherein homeowners frequently install or build their own deck systems.

With another conventional railing system, the spindles are attached to the sides of the top and bottom rail. In other words, the spindles do not extend between the inwardly facing surfaces of the rails, but are nailed or screwed to the sides or edges of the rails. The spindles typically include angled ends that "merge" into the sides of the rails. This conventional system also has significant drawbacks. For example, most state building or construction codes require that the rail spindles are not spaced apart beyond a maximum distance. To attach such spindles to the sides of the rails, the spacing must be pre-measured and marked on the rails. This disadvantage also applies to channel-rail construction discussed above. Additionally, the spindles also have a tendency to "rack" or bow with respect to the rails over time, particularly with pressure treated lumber wherein the wood tends to alternately lose and absorb moisture. The ends of the spindles tend to pull away from the rails or the spindles bow and the railing system loses its finished uniform look over time.

The present invention relates to an inexpensive and simple railing system that overcomes a number of disadvantages noted with prior art systems.

OBJECTS AND SUMMARY OF THE INVENTION

It is thus a principal object of the present invention to provide an improved railing system particularly suited for outdoor use.

An additional object of the present invention is to provide rails for use in outdoor railing systems that eliminate many disadvantages of conventional rails.

Still an additional object of the present invention is to provide improved prefabricated rail sections that are relatively easy to install.

And yet another object of the present invention is to provide improved top and bottom rails for outdoor railing systems that can accommodate any number of conventional spindles.

Still another object of the present invention is to provide improved outdoor railing system rails that help the railing system retain its finished appearance over a longer period of time without additional expense or processes in building the railing system.

In accordance with the objects and advantages of the invention, a rail is provided for an outdoor railing system wherein a plurality of vertically disposed spindles are attached to upper and lower embodiments of the rail. The rail includes outwardly and inwardly disposed surfaces defined along the longitudinal length thereof. The spindles are attached to the rail along the inwardly disposed surfaces. When two such rails are used, the spindles extend between the inwardly facing surfaces of the rails.

A plurality of equally spaced recess configurations are defined in the rails along the inwardly disposed surfaces for receipt of the spindle ends. The spindle ends are anchored to the rails within the recesses. Preferably, the recesses are spaced so that the spindles are in accordance with building or construction codes.

A unique feature of the invention is the recess configurations. Each configuration includes a first multi-sided recess of a first size having sides and a bottom surface for anchoring a spindle having an end of complimentary size. Each recess configuration also includes an additional second multi-sided recess defined within the first multi-sided recess. The second recess is of a smaller size than the first recess and also includes sides and a bottom surface for anchoring a spindle having an end of smaller complimentary size.

In this manner, the rails can accommodate a vast number of different styles and sizes of spindles. In other words, the rails can act as a "universal" rail for a number of spindle sizes and shapes. This is of particular advantage to manufacturers and retailers of railing and deck systems in that different rails need not be produced and stocked for different sized spindles.

In a preferred embodiment, the second recess is defined in the bottom surface of the first recess. The first and second recesses are multi-sided, for example having four sides, and have a shape so as to engage at least two sides of the spindle end inserted therein. In this manner, the spindles are prevented from twisting or racking within the recesses. It should be appreciated that it is not necessary that the recesses have an exact complimenting or matching shape as the spindle end so long as the spindles are engaged by the multi-sided recess to the extent necessary to prevent the spindles from twisting within the recesses. For example, the recesses may have a rectangular shape whereas the spindles have square ends, or vice versa. The square ends of the spindles still fit within the recesses and will be engaged by at least two sides of the recesses. In this manner, any manner of multi-sided configurations is within the scope and spirit of the invention.

The first and second recesses have bottom surfaces that are preferably flat so that a flat end of the spindle can abut against the bottom surfaces. Likewise, the sides of the recesses may also be generally flat or straight so as to engage against sides of the spindles.

Although the present rails and railing system are particularly suited for outdoor systems and, in this regard, are preferably formed of lumber or wood, including pressure treated lumber, the present invention is not limited to any particular material. For example, the rails and railing system may be made of a plastic material, or any other suitable material.

It should also be appreciated that the first and second recesses need not have the same multi-sided shape. For example, the first recess may comprise a rectangular or square shape whereas the second recess defined within the first recess may comprise a triangular or other multi-sided shape. Again, any number of configurations are within the scope and spirit of the invention.

The present invention also relates to an outdoor railing system comprising top and bottom rails with spindles attached between the top and bottom rails. The top and bottom rails are as described above. The railing system according to the invention may comprise a prefabricated length or section having the top and bottom rails as described above with the spindles already anchored or attached within the recess configurations.

Alternatively, the present invention includes a railing system that is not prefabricated, but is constructed on site with rails according to the invention.

Specific preferred embodiments of the invention will be described below through use of the attached figures.

DETAILED DESCRIPTION

Figure 1:
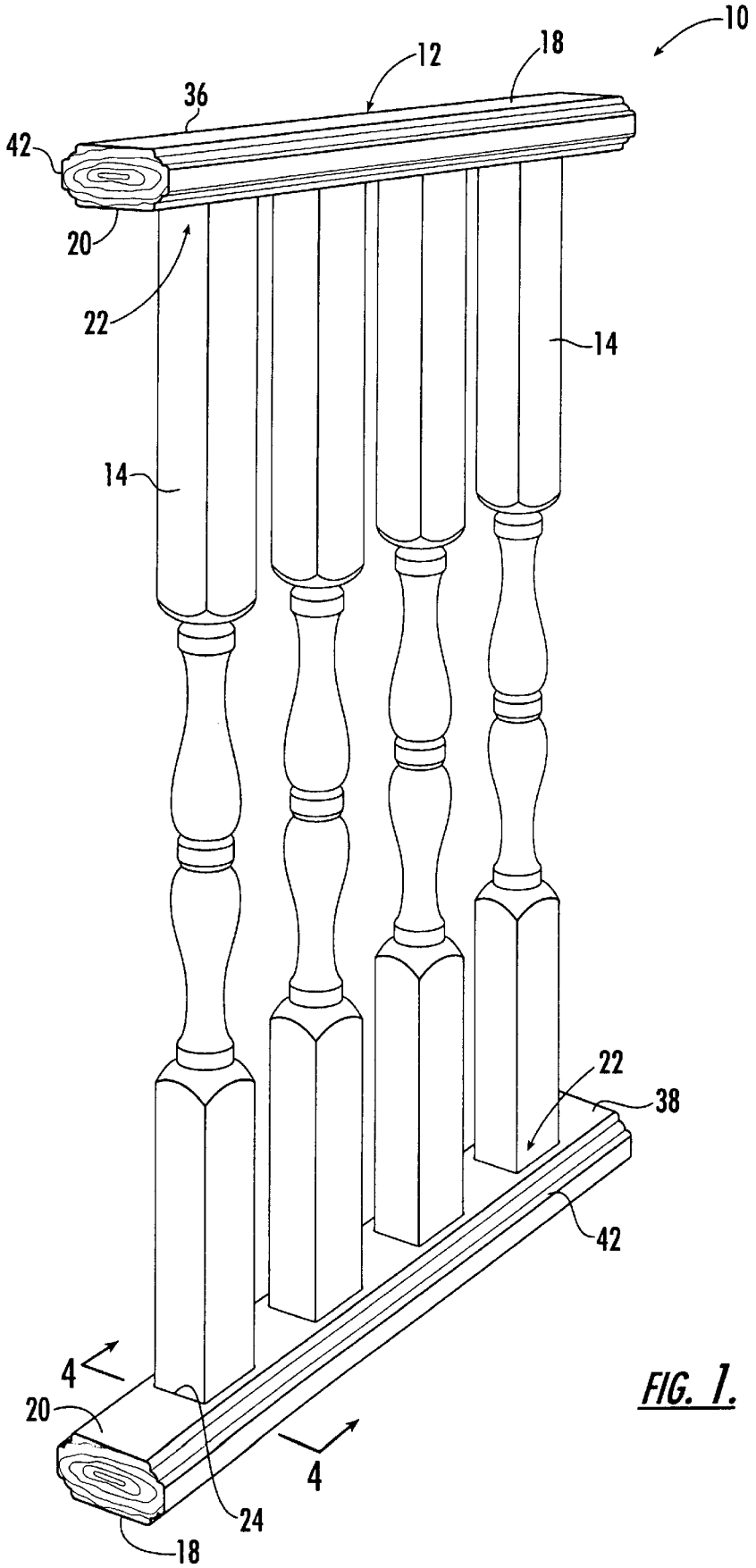
FIG. 1 is a perspective view of a railing system according to the invention with the unique top and bottom rails.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

FIG. 1 illustrates a railing system, generally 10, according to the invention. Railing system 10 is illustrated only as a section of a railing system for purposes of illustration. It should be understood that the present invention includes a complete railing system, as well as pre-fabricated sections of a railing system that may be manufactured and sold in standard lengths. Such pre-fabricated railing sections are particularly popular in the residential home decking industry.

It should also be appreciated that the present invention is not limited to any particular type of material. Although most outdoor decking and railing systems are conventionally made of lumber, for example pressure treated lumber, the present invention is not limited to wood or lumber. The components of the rails and railing system may be made of any construction material, for example a plastic material, cementious material, etc. Any and all such materials are within the scope and spirit of the invention.

Railing system 10 according to the invention utilizes a unique top or bottom rail, generally 12. Preferably, the railing system 10 incorporates a top rail 36 and a bottom rail 38 that are essentially identical. In this regard, the present invention also includes either of the top rail or bottom rail as a separate component that may be manufactured or sold separate from a pre-fabricated rail section for use in a railing system.

When constructed, railing section 10 includes top rail 36, and bottom rail 38 having a plurality of spindles 14 attached between the inwardly facing surfaces 20 of the top and bottom rails. Each rail also includes an outwardly facing surface 18 and side edges 42. A decorative profile may be defined on side edges 42. As generally illustrated in FIG. 1, the top and bottom rails 36, 38 include a plurality of generally equally spaced recess configurations, generally 22, defined along the longitudinal length thereof in the inwardly facing surfaces 20. The ends 16 of the spindles are inserted into and anchored relative to rails 12 by way of recess configurations 22.

Figure 2:
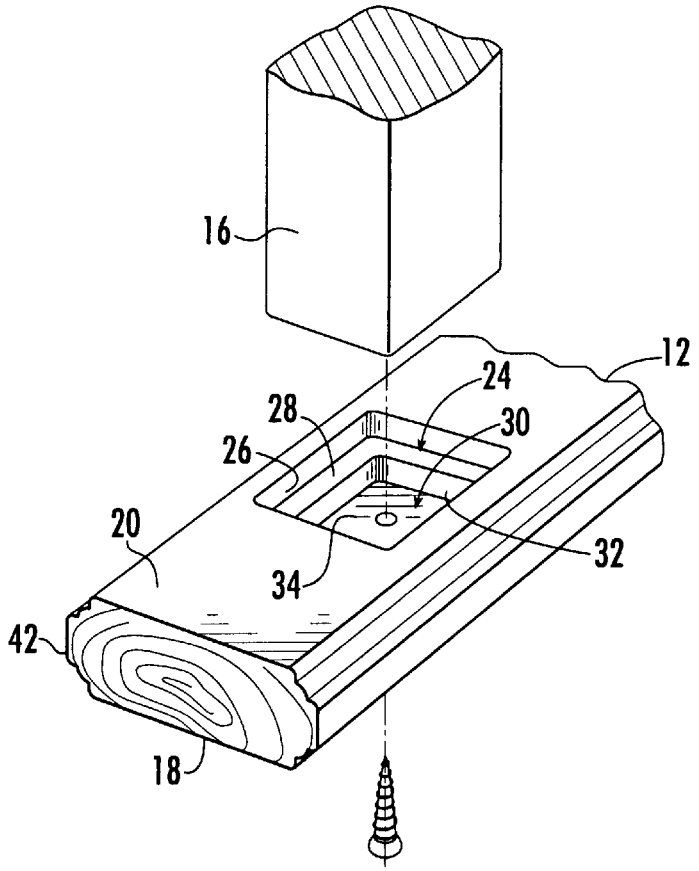
FIG. 2 is a partial perspective view of a spindle end and bottom rail.
Figure 3:
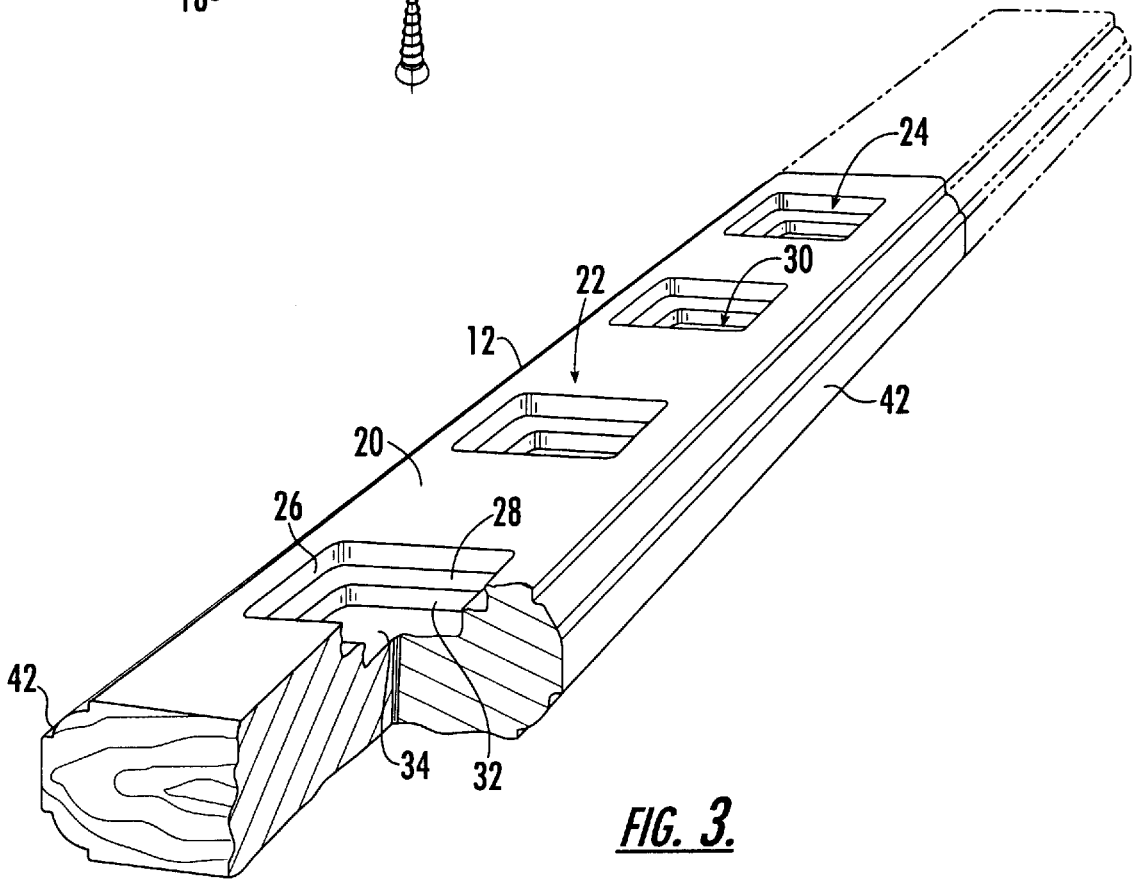
FIG. 3 is a lengthwise partial cross-sectional view of a rail according to the invention particularly illustrating the recess configurations.
Figure 4:
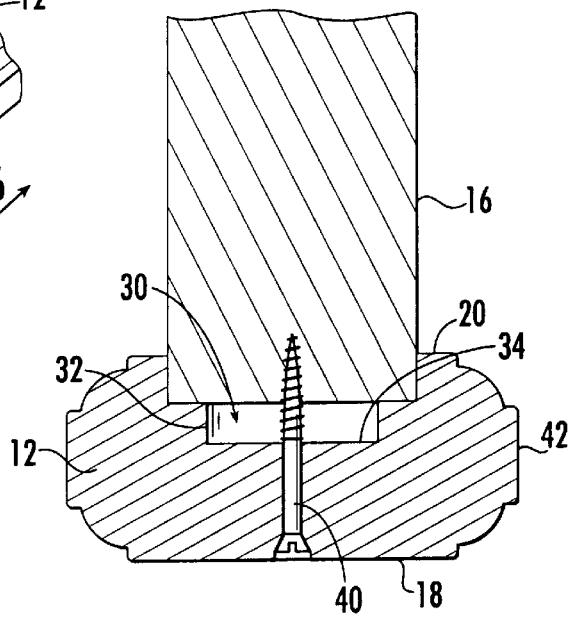
FIG. 4 is a cross-sectional end view taken along the lines indicated in FIG. 1.
Figure 7:
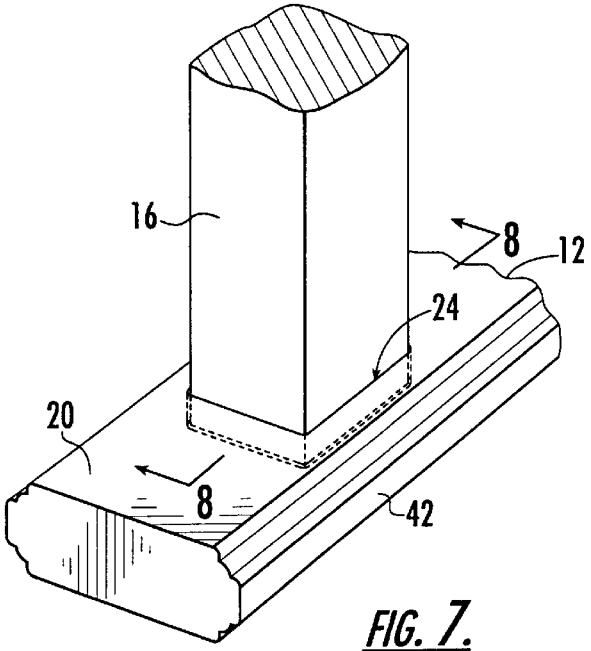
FIG. 7 is a perspective view of a spindle end inserted into the first multi-sided recess.
Figure 8:
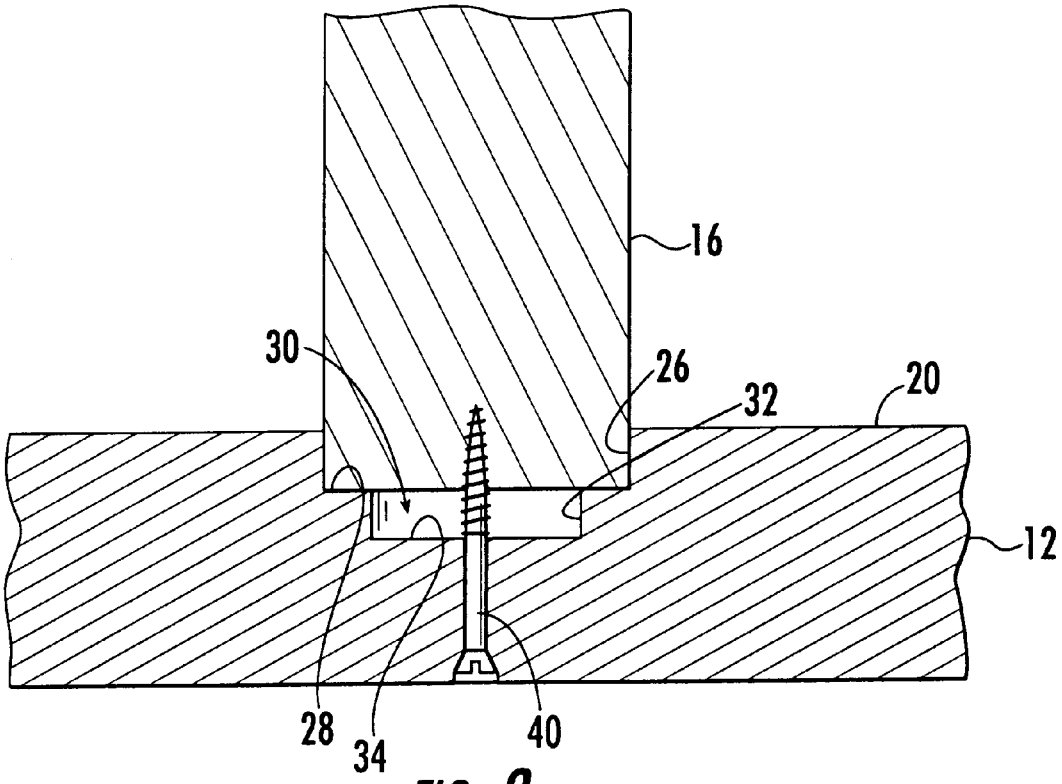
FIG. 8 is a cross-sectional view of the embodiment of FIG. 7 taken along the lines indicated.

FIGS. 2 and 3 illustrate the recess configurations 22 in greater detail. Each recess configuration includes a first multi-sided recess 24 and a second multi-sided recess 30 defined within first multi-sided recess 24. For example, in the embodiment illustrated in FIGS. 2 and 3, first multi-sided recess 24 is defined by sides 26 and a bottom surface 28. First multi-sided recess 24 has a first size for accommodating ends 16 of spindles 14 having a complimenting size. It should be appreciated that end 16 need not have an exact matching shape of the multi-sided recess. For example, multi-sided recess 24 may be rectangular whereas end 16 of the spindle is square so long as at least two sides of end 16 abut against sides 26 of recess 24 to lock end 16 within recess 24. In this regard, it should be appreciated that multi-sided recess 24 can taken on any number of multi-sided configurations. FIGS. 4, 7, and 8 illustrate attachment of a relatively larger sized spindle end 16 with a first multi-sided recess 24.

Figure 5:
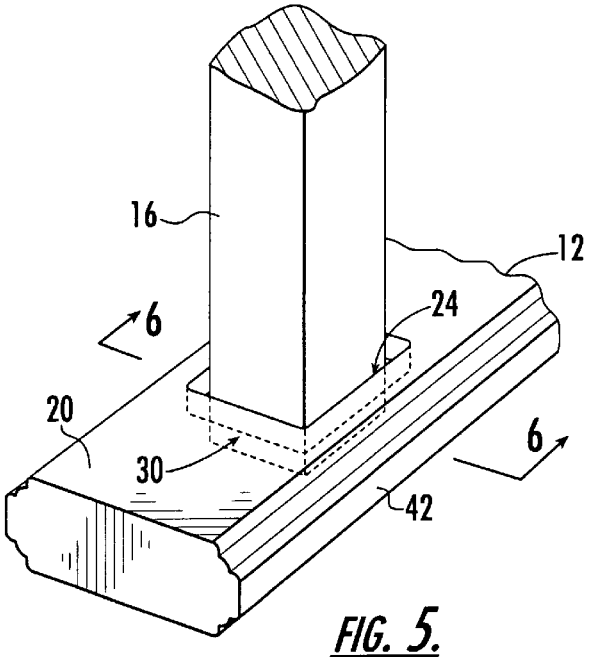
FIG. 5 is a partial assembled view illustrating a spindle end inserted into the second multi-sided recess.
Figure 6:
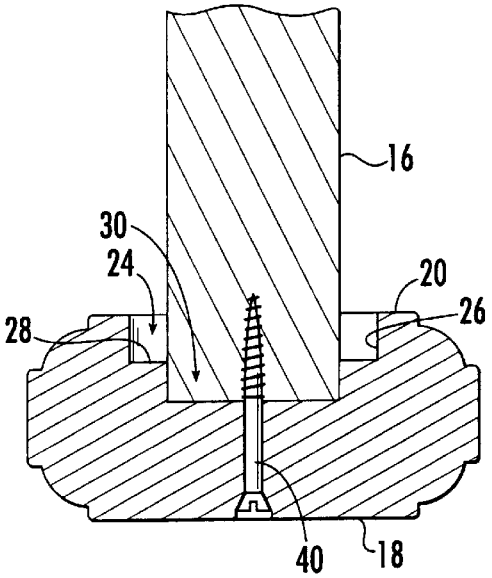
FIG. 6 is a cross-sectional view of the embodiment illustrated in FIG. 5 taken along the lines indicated.

Second multi-sided recess 30 is defined within first multi-sided recess 24 and includes a bottom surface 34 and sides 32. Thus, bottom surface 28 of first recess 24 defines the top plane of second multi-sided recess 30. Second multi-sided recess 30 thus has a smaller size than first multi-sided recess 24 for accommodating spindle ends of a lesser or smaller size. This concept is particularly illustrated in FIGS. 5 and 6.

Preferably, the respective sides and bottoms of recesses 24, 30 are generally flat so that correspondingly flat sides and bottoms of spindle ends 16 can abut against these surfaces for secure anchoring of the spindles. The spindles may be further anchored within the recesses by conventional screws 40, adhesives, nails, etc.

It should be understood that the first and second multi-sided recesses 24, 30 do not necessarily need to have the same shape or configuration, although for ease of manufacturing this may be preferred. For example, the first multi-sided recess 24 may be rectangular whereas second multi-sided recess 30 may be square and vice versa.

Preferably, the plurality of recess configurations 22 are spaced apart along the length of rails 12 so as to meet restrictive codes. In this way, the rails need not be measured for placement of the spindles 14.

Once the spindle ends 16 are anchored within either of the multi-sided recesses 24, 30, they are prevented from twisting or torquing relative to top and bottom rails 36, 38 and the rail system 10 retains a professional finished appearance over a longer period of time. Also, as seen in FIG. 1, ends 16 of spindles 14 extend into recess configurations 22 so as to give the rail system 10 a "finished" appearance without the necessity of attaching additional face strips or boards along edges 42. This significantly cuts back in material, expenses, and labor.

The exact depth and dimensions of recesses 24, 30 are not particularly critical so long as the recesses have a sufficient depth to accommodate spindles ends 16 taking into account shrinkage and expansion of the spindles over time as they tend to lose and absorb moisture. Likewise, the depth should not be so great so as to weaken the structural integrity of rails 12.

It should be appreciated by those skilled in the art that various modifications and variations can be made in the present invention without departing from the scope and spirit of the invention. For example, the first and second recesses may have any number of multi-sided configurations to prevent the spindle ends from twisting or torquing within the recesses. Likewise, the rails and railing system may be made of any conventional construction material. It is intended that the present invention include such modifications and variations as come within the scope of the appended claims and their equivalents.

What is claimed is:

1. A rail for an outdoor railing system wherein a plurality of vertically disposed spindles are attached to an upper and lower of said rail, said rail comprising:

outwardly and inwardly disposed surfaces defined along a longitudinal length thereof, wherein spindles are attachable along said inwardly disposed surface;

a plurality of generally equally spaced recess configurations defined in said rail along said inwardly disposed surface for receipt of spindle ends to anchor the spindles to said rail;

each of said recess configurations further comprising a first multi-sided recess of a first size having sides and a bottom surface for anchoring a spindle having an end of complementary size; and each of said recess configurations further comprising a second multi-sided recess defined within said first multi-sided recess, said second recess being of a smaller size than said first recess and having sides and a bottom surface for anchoring a spindle having an end of complementary size.

2. The rail as in claim 1, wherein said second recess is defined in said bottom surface of said first recess.

3. The rail as in claim 1, wherein said first and second recesses have four sides.

4. The rail as in claim 1, wherein said first and second recess bottom surfaces are generally flat so that a spindle end can abut against said bottom surfaces.

5. The rail as in claim 1, wherein said rail is made of wood.

6. The rail as in claim 5, wherein said rail is made of pressure treated wood particularly suited for outdoor use.

7. The rail as in claim 1, wherein said rail can be used as a top or bottom rail in a railing system.

8. The rail as in claim 1, wherein said first and second recesses have a shape so as to engage spindle ends inserted therein along at least two sides so as to prevent the spindles from twisting within said recesses.

9. An outdoor railing system, comprising:

a top rail and a bottom rail with a plurality of generally equally spaced spindles attached between said top and said bottom rails;

each of said top and bottom rails further comprising outwardly and inwardly disposed surfaces defined along a longitudinal length thereof, wherein said spindles are attached along said inwardly disposed surface;

a plurality of generally equally spaced recess configurations defined in said top and bottom rails along said inwardly disposed surfaces for receipt of ends of said spindles to anchor said spindles to said rails;

each of said recess configurations further comprising a first multi-sided recess of a first size having sides and a bottom surface for anchoring said spindles having an end of complementary size; and each of said recess configurations further comprising a second multi-sided recess defined within said first multi-sided recess, said second recess being of a smaller size than said first recess and having sides and a bottom surface for anchoring said spindles of a smaller complementary size.

10. The railing system as in claim 9, wherein said system comprises a pre-fabricated length of said top and bottom rails with said spindles anchored within said recess configurations.

11. The railing system as in claim 9, wherein said second recess is defined in said bottom surface of said first recess.

12. The railing system as in claim 9, wherein said spindles are engaged against at least two said sides of said first or second recess so that said spindles are prevented from twisting within said respective recess.

13. The railing system as in claim 12, wherein said recesses comprise four sides.

14. The railing system as in claim 9, wherein said first and second recess bottom surfaces are generally flat so that said spindles abut against said bottom surfaces.

15. The railing system as in claim 9, wherein said top and bottom rails and said spindles are made of wood.

16. The railing system according to claim 1 wherein the first multi-sided recess further comprises a recess having at least three side walls.

17. The railing system according to claim 9 wherein the first multi-sided recess further comprises a recess having at least three side walls.

* * * * *